US008376737B2

(12) United States Patent
Kwak

(10) Patent No.: US 8,376,737 B2
(45) Date of Patent: Feb. 19, 2013

(54) HOT AIR BLOWER

(75) Inventor: Jae seok Kwak, Ansan-si (KR)

(73) Assignee: Paseco Co. Ltd. (KR)

( * ) Notice: Subject to any disclaimer, the term of this patent is extended or adjusted under 35 U.S.C. 154(b) by 1067 days.

(21) Appl. No.: 12/356,300

(22) Filed: Jan. 20, 2009

(65) Prior Publication Data

US 2009/0215001 A1 Aug. 27, 2009

(30) Foreign Application Priority Data

Feb. 27, 2008 (KR) ..... 10-2008-0017669

(51) Int. Cl.
*F24H 3/00* (2006.01)

(52) U.S. Cl. ..... 432/222; 432/219; 432/220; 432/221; 137/539; 137/522; 137/523

(58) Field of Classification Search ..... 122/1 A; 165/8–10; 110/104 R, 104 B; 432/219–222; 137/522, 523, 315.04, 512.3, 539; 126/110 B, 126/110 C; 335/220
See application file for complete search history.

(56) References Cited

U.S. PATENT DOCUMENTS

| | | | | |
|---|---|---|---|---|
| 3,319,947 | A * | 5/1967 | Truesdell | 432/32 |
| 3,999,597 | A * | 12/1976 | Sato | 165/9 |
| 5,398,744 | A * | 3/1995 | Street et al. | 152/429 |
| 5,950,623 | A * | 9/1999 | Michell | 128/205.24 |
| 7,360,555 | B2 * | 4/2008 | Bruhat et al. | 137/460 |
| 8,146,583 | B1 * | 4/2012 | Lee, Jr. | 126/110 B |
| 2010/0051119 | A1 * | 3/2010 | Klein | 137/540 |

* cited by examiner

*Primary Examiner* — Steven B McAllister
*Assistant Examiner* — Nathaniel Herzfeld
(74) *Attorney, Agent, or Firm* — Theresa Fritz Camoriano; Guillermo Camoriano; Camoriano and Associates

(57) ABSTRACT

Provided is a hot air blower comprising a fuel tank for storing fuel, an air compression pump for sucking air and compressing the air, a pressure regulation valve installed at the air compression pump to reduce the pressure of the compressed air, a burner assembly for receiving the fuel from the fuel tank and the air from the air compression pump, and a combustion chamber for receiving the fuel from the burner assembly and combusting the fuel, wherein the pressure regulation valve includes a high pressure regulation valve and a low pressure regulation valve, and a valve opening/closing means is installed at the low pressure regulation valve.

3 Claims, 12 Drawing Sheets

HOT AIR BLOWER

CROSS-REFERENCE TO RELATED APPLICATION

This application claims the benefit of Korean Patent Application No. 10-2008-0017669, filed Feb. 27, 2008, the disclosure of which is hereby incorporated herein by reference in its entirety.

BACKGROUND OF THE INVENTION

1. Field of the Invention

The present invention relates to a hot air blower, and more particularly, to a hot air blower including a pressure regulation valve for adjusting an air pressure supplied into a burner of the hot air blower at an appropriate pressure.

2. Description of the Prior Art

In general, hot air blowers are used to provide hot air into a closed space such as a plant or remove moisture from a green house such as a vinyl house, a cow house, and so on.

The hot air blowers may be classified into an electric heat exchange type of applying electricity to a heater or a hot-wire coil to heat sucked air to a high temperature and then discharging the hot air to the exterior using the blower, or a combustion heating type of combusting fuel in a combustion chamber to heat air and discharge the heated air using a blowing fan.

FIGS. 1 and 2 show a typical example of the combustion heating type hot air blower, among the hot air blowers.

The combustion heating type hot air blower includes a blower body 10 having a fuel tank 12 disposed at its lower part a combustion chamber 20 disposed in front of the blower body 10 and over the fuel tank 12, a burner assembly 22 having an injection nozzle 22*a* installed at a rear part of the combustion chamber 20 to inject fuel and an ignition plug 22*b* for igniting the fuel, a vane pump 28 connected to the burner assembly 22 via a fuel supply line 24 and generating a predetermined pressure to supply fuel, a blower fan 32 for blowing air into the combustion chamber 20, and a drive motor 30 for rotating the blower fan 32.

The vane pump 28 is merely an example of an air compression pump, and other kinds of air compression pumps may be installed in the blower.

In addition, the blower includes a controller (not shown) for controlling the entire operation, a pair of wheels 14 installed at a lower end of the blower body 10 to enable movement of the blower, a stopper 16 installed opposite to the wheels 14, and a handle 18 installed at an upper part of the blower body 10.

Further, as shown in FIGS. 3A and 3B, the blower includes a pressure regulation valve 40 installed at one side of the vane pump 28 to supply introduced air through an air suction port 10*a* at an appropriate pressure. The pressure regulation valve 40 is positioned on a path through which the compressed air generated by the vane pump 28 moves to the burner assembly 22.

The pressure regulation valve 40 adjusts a supply pressure of the air compressed by the vane pump 28 to supply the air into the injection nozzle 22*a* of the burner assembly 22 at an appropriate pressure.

Hereinafter, the above constitution will be described in detail.

First, the vane pump 28 includes a rotor 35 rotated by the drive motor 30, a front housing 28*d* installed at one side of the rotor 35, and a rear housing 28*e* installed opposite to the front housing 28*d*. The rotor 35 constitutes a compression part of the vane pump 28.

In addition, a chamber 37 in which air flows is formed between the front housing 28*d* and the rear housing 28*e*.

Further, the front housing 28*d* and the rear housing 28*e* have separation projections 28*f* and 28*g* projecting from their inner surfaces toward each other, respectively. The separation projections 28*f* and 28*g* are adhered to each other via a gasket 28*h* to divide the chamber 37 into an introduction chamber 37*a* and a compression chamber 37*b*.

Furthermore, the rear housing 28*e* has the air suction port 10*a* in communication with the introduction chamber 37*a*.

The introduction chamber 37*a* includes a filter 36 for filtering foreign substances included in the air passing therethrough.

In addition, as shown in FIG. 3B, an introduction hole 28*a* is formed in the front housing 28*d* corresponding to the introduction chamber 37*a* to introduce the air passed through the filter 36 into the rotor 35.

Further, a discharge hole 28*b* is formed in the front housing 28*d* corresponding to the compression chamber 37*b* to discharge the air compressed by the rotor 35 to the compression chamber 37*b*.

The compression chamber 37*b* also has a filter 38 to filter foreign substances included in the compressed air discharged through the discharge hole 28*b*.

An air line 28*c* is formed around the compression chamber 37*b* to convey the compressed air to the burner assembly 22.

In addition, the pressure regulation valve (or a relief valve) 40 is installed at the rear housing 28*e* to lower the pressure of the compressed air discharged from the vane pump 28. The pressure regulation valve 40 is installed in a hole 42 formed in the rear housing 28*e* so that the compressed air is discharged through the hole 42.

The air in the compression chamber 37*b* lowered to a predetermined value by the pressure regulation valve 40 is conveyed to the burner assembly 22 through the air line 28*c*.

A partition wall 28*j* is formed in the compression chamber 37*b* to divide the chamber 37*b* into a space in which the air line 28*c* is formed and a space in which the pressure regulation valve 40 is installed. A relatively small through-hole 39 is formed in the partition wall 28*j*. Therefore, it is possible to prevent the air of pressure higher than the predetermined value from being discharged through the air line 28*c*.

In addition, a pressure gauge and a plug 41 are installed at the rear housing 28*e* adjacent to the through-hole 39 to close a pressure gauge port for measuring the pressure of the compressed air.

The pressure regulation valve 40 is installed in the hole 42, and includes a ball 43, a spring 44, and a pressure regulation screw 45.

Therefore, when the pressure regulation screw 45 is tightened, the spring 44 is compressed to prevent displacement even at a high pressure. When the pressure regulation screw 45 is loosened, the spring 44 is released to cause displacement even at a lower pressure.

Hereinafter, a process of reducing the pressure of the air compressed by the vane pump 28 using the pressure regulation valve 40 and supplying the air into the injection nozzle 22*a* will be described.

The exterior air introduced into the air suction port 10*a* is introduced into the rotor 35 of the vane pump 28 via the filter 36 in the introduction chamber 37*a* and the introduction hole 28*a*, and the air compressed by the rotor 35 is discharged through the discharge hole 28*b* to move to the compression chamber 37*b* via the air filter 38.

As described above, the compressed air moved into the compression chamber 37*b* passes through the through-hole 39 and then moves to the air line 28*c* to be supplied into the injection nozzle 22*a* of the burner assembly 22.

A manufacturer can adjust the pressure of the air discharged from the vane pump 28 using the pressure regulation valve 40 to supply the air into the injection nozzle 22*a* at a uniform pressure.

In addition, the compressed air supplied into the injection nozzle 22*a* moves along the air line 28*c* to suck fuel in the fuel tank 12 to supply the fuel into the injection nozzle 22*a*. When the air pressure is high, the amount of the sucked fuel is increased, and when the air pressure is low, the amount of the sucked fuel is reduced.

Therefore, when the compressed air is supplied into the injection nozzle 22*a* at a high pressure, a heating value is raised, and when the compressed air is supplied at a low pressure, a heating value is lowered.

That is, the pressure of the compressed air discharged from the vane pump 28 is different according to the hot air blower. For example, when the pressure regulation valve 40 is set to be opened at 7 psi, even when the pressure of the compressed air supplied into the injection nozzle 22*a* of the burner assembly 22 is higher than 7 psi, the compressed air is supplied into the injection nozzle 22*a* at the pressure of 7 psi.

For example, when the pressure of the compressed air discharged from the vane pump 28 installed in the hot air blower is 10 psi, the pressure regulation valve 40 is opened to reduce the pressure of the compressed air in the compression chamber 37*b* to 7 psi and then supply the compressed air to the injection nozzle 22*a*. Even when the pressure of the compressed air discharged from the vane pump 28 installed at another hot air blower is 9 psi, the pressure regulation valve 40 reduces the pressure to 7 psi and then supplies the compressed air to the injection nozzle 22*a*.

As described above, since the conventional hot air blower is set to a fixed pressure by the manufacturers, it is difficult for a user to adjust the pressure of the compressed air according to necessities.

That is, since the conventional hot air blower includes a single pressure regulation valve set to a certain discharge pressure, it is difficult for a user to adjust the pressure of the compressed supplied to the burner assembly.

As a result, when it is needed to reduce a heating value of the conventional hot air blower, operation of the hot air blower must be stopped.

In addition, in order to adjust the heating value generated in the combustion chamber, an expensive two-stage electronic pump may be installed instead of the vane pump. However, in this case, manufacturing cost of the hot air blower is increased, and installation of the two-stage electronic pump complicates the structure of the hot air blower.

SUMMARY OF THE INVENTION

An object of the present invention is to provide a hot air blower capable of selectively adjusting the pressure of compressed air to appropriately adjust a heating value generated in the hot air blower.

The present invention provides a hot air blower including: a fuel tank for storing fuel; an air compression pump for sucking air and compressing the air; a pressure regulation valve installed at the air compression pump to reduce the pressure of the compressed air; a burner assembly for receiving the fuel from the fuel tank and the air from the air compression pump; and a combustion chamber for receiving the fuel from the burner assembly and combusting the fuel, wherein the pressure regulation valve includes a high pressure regulation valve and a low pressure regulation valve, and a valve opening/closing means is installed at the low pressure regulation valve.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EXEMPLARY EMBODIMENTS

Figure 1:
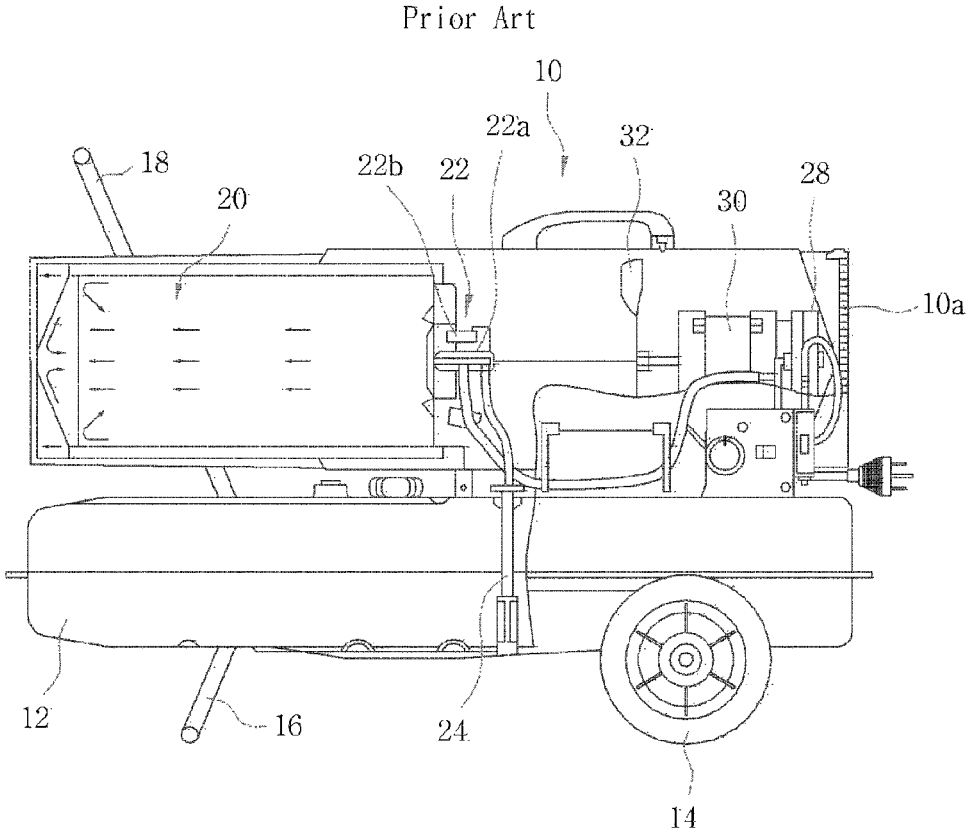
FIG. 1 is a front view of a conventional hot air blower.
Figure 2:
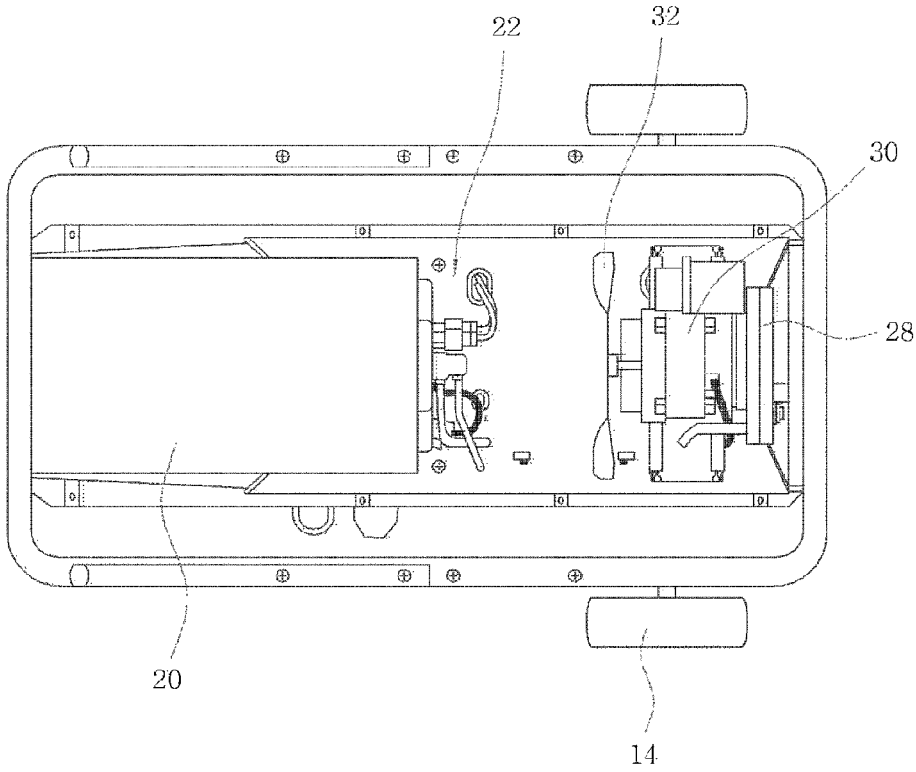
Fig. 2 Prior Art
FIG. 2 is a plan view of the conventional hot air blower.

Hereinafter, exemplary embodiments of the present invention will be described with reference to the accompanying drawings. Like reference numerals designate like elements throughout the conventional invention.

First Embodiment

Figure 4:
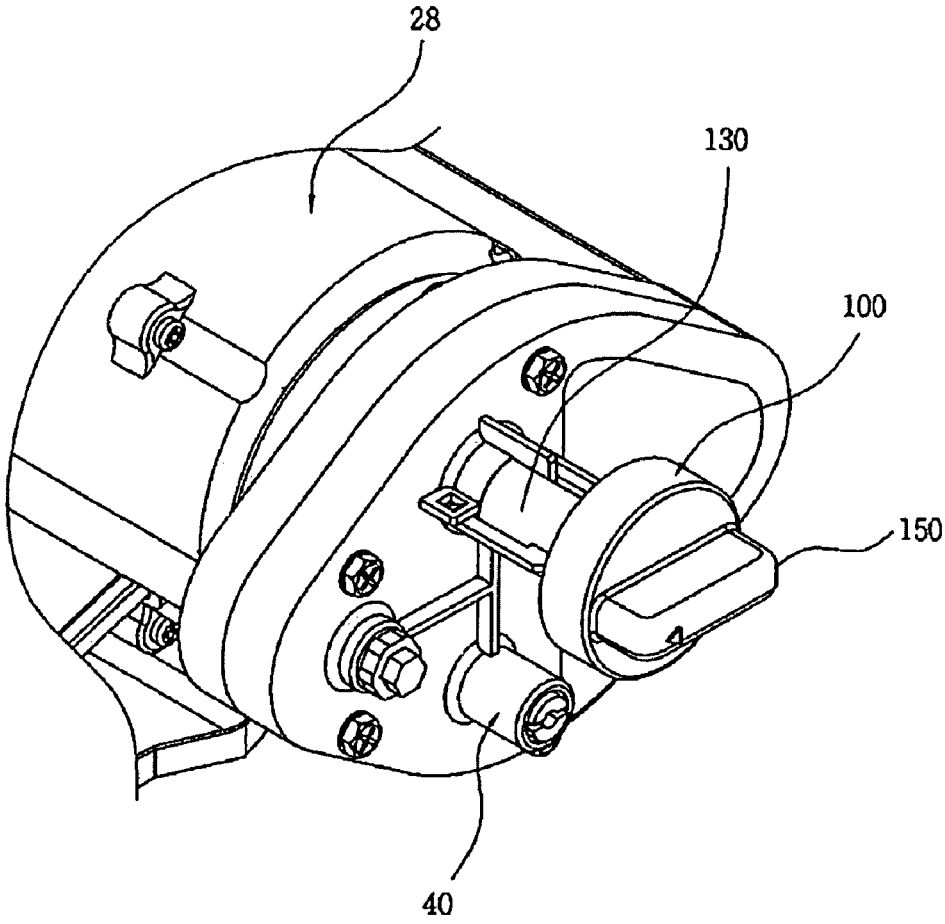
FIG. 4 is a perspective view of a hot air blower including a pressure regulation valve in accordance with a first exemplary embodiment of the present invention.
Figure 5:
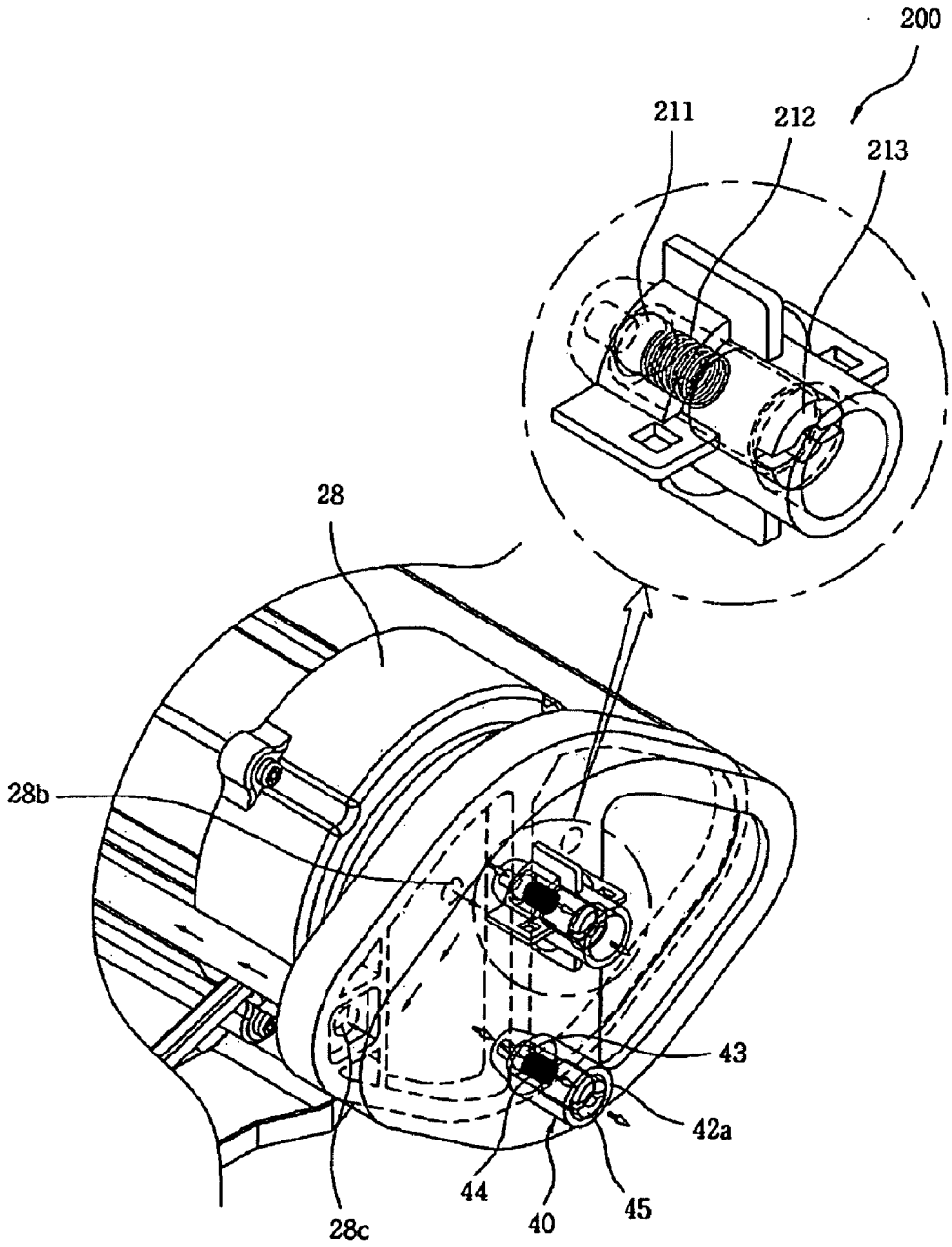
FIG. 5 is an enlarged perspective view of the pressure regulation valve in accordance with a first exemplary embodiment of the present invention.
Figure 6:
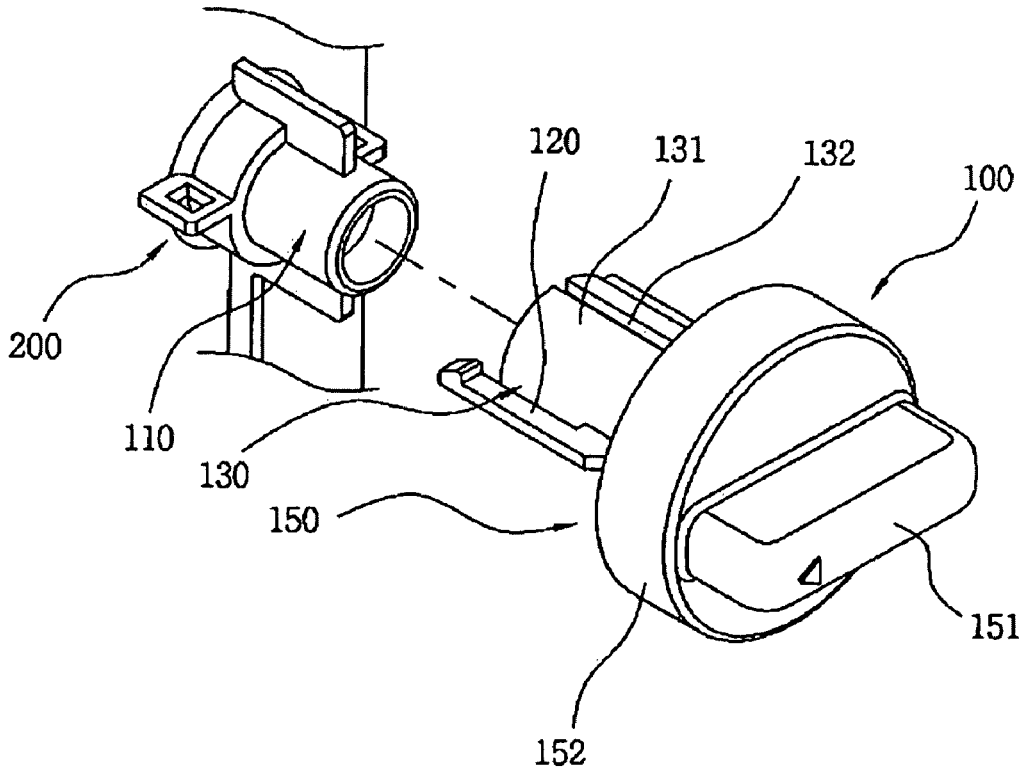
FIG. 6 is an exploded perspective view of the pressure regulation valve in accordance with a first exemplary embodiment of the present invention.
Figure 7:
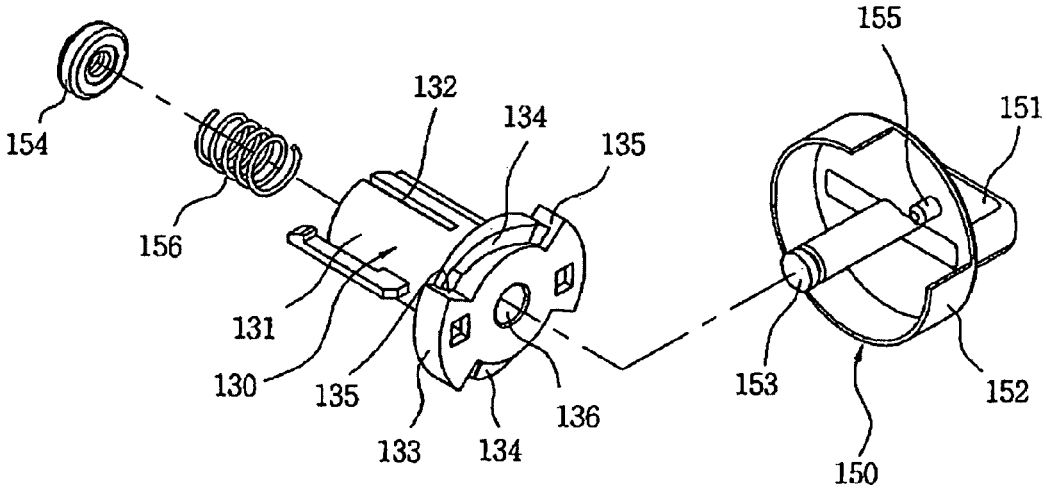
FIG. 7 is a further exploded perspective view of the pressure regulation valve in accordance with a first exemplary embodiment of the present invention.
Figure 8:
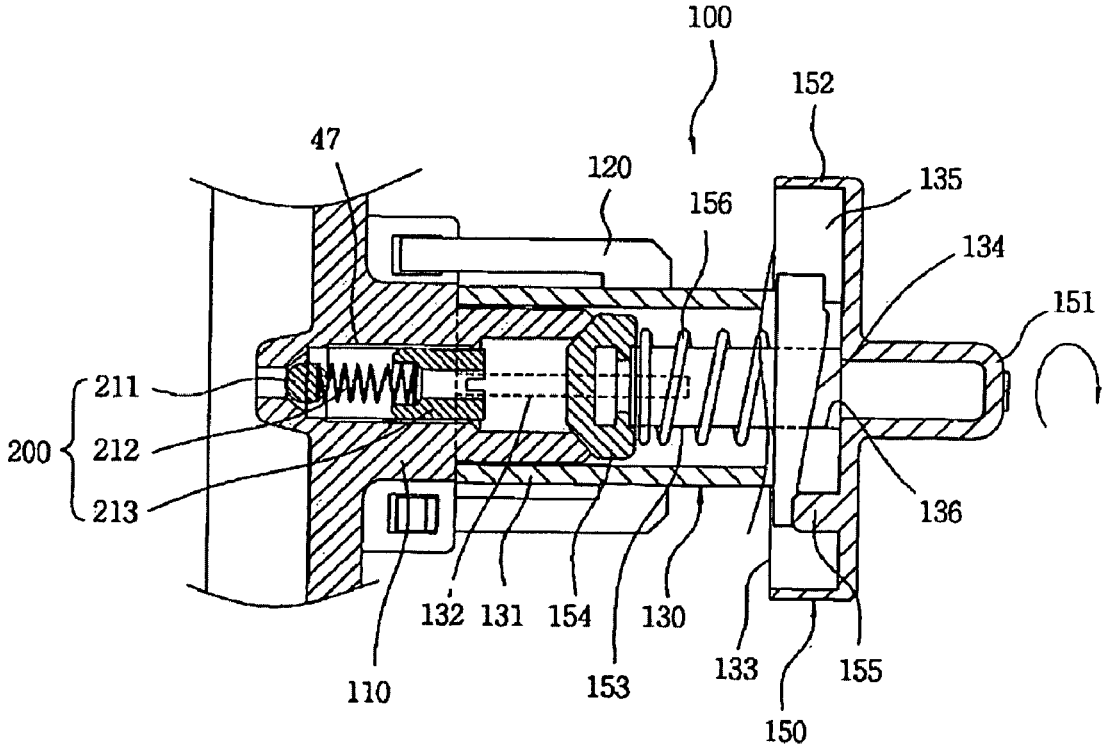
FIG. 8 is a cross-sectional view of the pressure regulation valve in accordance with a first exemplary embodiment of the present invention, showing a closed state of the valve.
Figure 9:
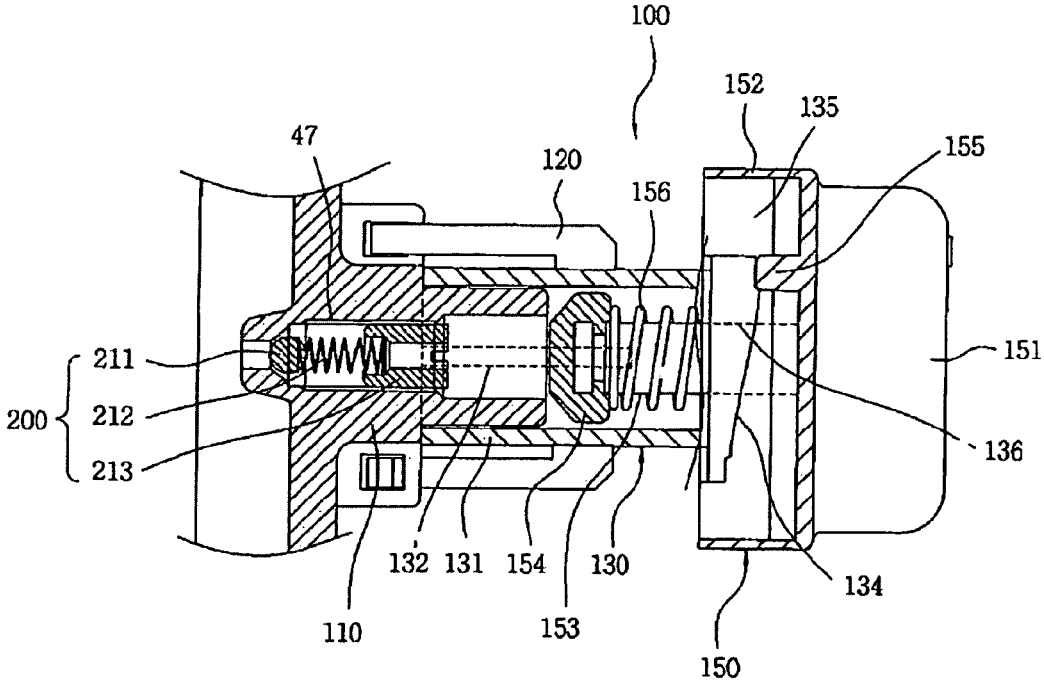
FIG. 9 is a cross-sectional view of the pressure regulation valve in accordance with a first exemplary embodiment of the present invention, showing an open state of the valve.

FIG. 4 is a perspective view of a hot air blower including a pressure regulation valve in accordance with a first exemplary embodiment of the present invention; FIG. 5 is an enlarged perspective view of the pressure regulation valve in accordance with a first exemplary embodiment of the present invention; FIG. 6 is an exploded perspective view of the pressure regulation valve in accordance with a first exemplary embodiment of the present invention; FIG. 7 is a further exploded perspective view of the pressure regulation valve in accordance with a first exemplary embodiment of the present invention; FIG. 8 is a cross-sectional view of the pressure regulation valve in accordance with a first exemplary embodiment of the present invention, showing a closed state of the valve; and FIG. 9 is a cross-sectional view of the pressure regulation valve in accordance with a first exemplary embodiment of the present invention, showing an open state of the valve.

Similar to the conventional art, the hot air blower of the first embodiment includes a blower body 10 having a fuel tank 12 disposed at its lower part, a combustion chamber 20 disposed in front of the blower body 10 and over the fuel tank 12, a burner assembly 22 having an injection nozzle 22*a* installed at a rear part of the combustion chamber 20 to inject fuel and an ignition plug 22*b* for igniting the fuel, a vane pump 28 connected to the burner assembly 22 via a fuel supply line 24 and generating a predetermined pressure to supply fuel, a blower fan 32 for blowing air into the combustion chamber 20, and a drive motor 30 for rotating the blower fan 32. (See FIG. 1)

Of course, relative positions between the fuel tank 12, the blower body 10, the combustion chamber 20, the burner assembly 22, the vane pump 28, the drive motor 30, and so on, may be varied, if necessary.

Figure 3A:
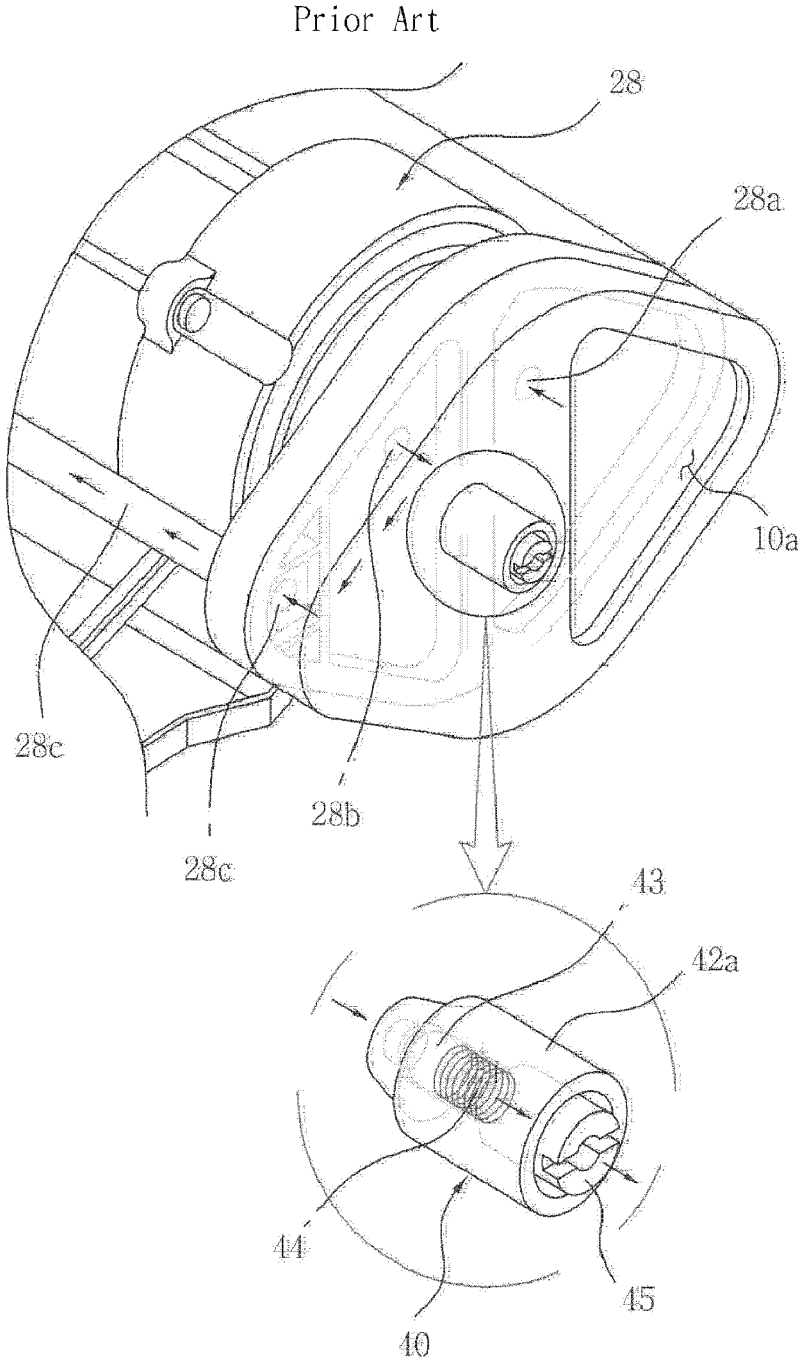
FIG. 3A is a perspective view of a conventional pressure regulation valve.
Figure 3B:
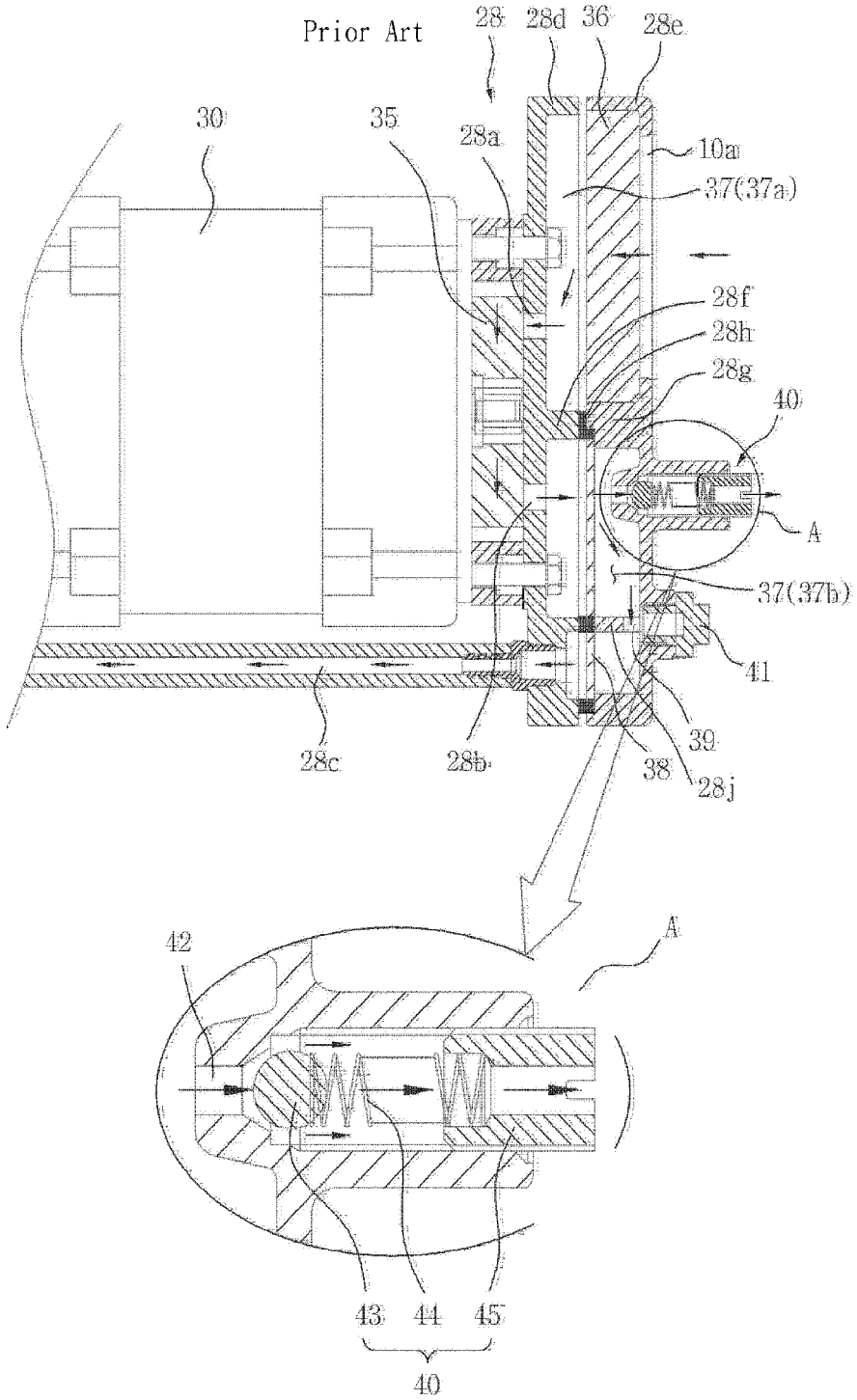
FIG. 3B is a cross-sectional view of the conventional pressure regulation valve of FIG. 3A.

The vane pump 28 includes a rotor 35 rotated by the drive motor 30, a front housing 28*d* installed at one side of the rotor 35, and a rear housing 28*e* installed opposite to the front housing 28*d*. The rotor 35 constitutes a compression part of the vane pump 28. (See FIGS. 3A and 3B)

In addition, a chamber 37 in which air flows is formed between the front housing 28*d* and the rear housing 28*e*.

Further, the front housing 28*d* and the rear housing 28*e* have separation projections 28*f* and 28*g* projecting from their inner surfaces toward each other, respectively. The separation projections 28*f* and 28*g* are adhered to each other via a gasket 28*h* to divide the chamber 37 into an introduction chamber 37*a* and a compression chamber 37*b*.

Furthermore, the rear housing 28*e* has an air suction port 10*a* in communication with the introduction chamber 37*a*.

In addition, an introduction hole 28*a* is formed in the front housing 28*d* corresponding to the introduction chamber 37*a* to introduce the air passed through a filter 36 into the rotor 35.

Further, a discharge hole 28*b* is formed in the front housing 28*d* corresponding to the compression chamber 37*b* to discharge the air compressed by the rotor 35 to the compression chamber 37*b*.

The compression chamber 37*b* also has a filter 38 to filter foreign substances included in the compressed air discharged through the discharge hole 28*b*.

An air line 28*c* is formed around the compression chamber 37*b* to convey the compressed air to the burner assembly 22.

Here, the filters 36 and 38 may be selectively employed, not necessarily.

As shown in FIGS. 4 to 9, the hot air blower in accordance with the present invention includes a high-pressure regulation valve 40 and a low-pressure regulation valve 200, which are disposed adjacent to the compression chamber 37*b* of the rear housing 28*e*. The low-pressure regulation valve 200 includes a valve opening/closing switch 100 for opening/closing the low-pressure regulation valve 200.

Among them, the high-pressure regulation valve 40 is set to be opened when a high-pressure is applied, and the low-pressure regulation valve 200 is set to be opened at a pressure lower than that of the high-pressure regulation valve 40.

The pressure regulation valves may use the conventional pressure regulation valves or other general relief valves.

Meanwhile, since the high-pressure regulation valve 20 has been described in the description of the prior art, the description will not be repeated.

Similar to the high-pressure regulation valve 40, the low-pressure regulation valve 200 also project backward from the rear housing 28*e*, and includes a discharge port 110 having a hole 47, a ball 211 installed in the hole 47 of the discharge port 110 to open/close the hole 47, a spring 212 resiliently supporting the ball 211, and a pressure regulation screw 213 coupled to the discharge port 110.

Therefore, a predetermined discharge pressure of the compressed air can be set by adjusting an insertion length of the pressure regulation screw 213 and a compression length of the spring 212.

Hereinafter, the valve opening/closing switch 100 will be described with reference to FIGS. 4 to 9 in detail.

As shown in FIGS. 4 to 7, the valve opening/closing switch 100 includes a valve body 130 coupled to the discharge port 110, and a rotation drive part 150 rotatably coupled to one side of the valve body 130.

As shown in FIGS. 6 and 7, the valve body 130 includes a hollow coupling pipe 131 fitted onto the discharge port 110 by a fastener 120 formed at a side part thereof, a discharge groove 132 formed in a longitudinal direction of the coupling pipe 131, a coupling part 133 disposed opposite to the discharge port 110 and having a diameter larger than that of the coupling pipe 131, and an inclined surface 134 formed along a periphery of the coupling part 133.

Here, a coupling hole 136 is formed in a center of the coupling part 133 so that a fixing rod 153 of the rotation drive part 150 is fixed thereto, and stoppers 135 are formed at both ends of the inclined surface 134 so that the rotation drive part 150 is rotated to a predetermined angle.

Meanwhile, a handle 151 is formed at a rear surface of the rotation drive part 150 to allow a user to grip the handle 151, and a coupling body 152 projects from a front surface of the rotation drive part 150 to be coupled to the coupling part 133 of the valve body 130.

In addition, a packing member 154 is fixed to a front end of the fixing rod 153 of the rotation drive part 150, and a guide projection 155 projects from the surface, on which the fixing rod 153 is formed, to be in contact with the inclined surface 134.

Further, a resilient member 156 is installed between the coupling part 133 and the packing member 154.

The packing member 154 opens and closes the hole 47 of the discharge port 110 with a pressure set by the resilient member 156.

Hereinafter, an example in which the high-pressure regulation valve 40, the low-pressure regulation valve 200 and the valve opening/closing switch 100 are installed at the vane pump 28 will be described.

Here, the vane pump 28 is merely an example of an air compression pump, other kinds of air compression pumps may be installed.

The high-pressure regulation valve 40 and the low-pressure regulation valve 200 are set to be opened at different pressures. For example, in this embodiment, the high-pressure regulation valve 40 is set to be opened when the compressed air is higher than 7 psi, and the low-pressure regulation valve 200 is set to be opened when the compressed air is higher than 5 psi.

Of course, the high-pressure regulation valve 40 and the low-pressure regulation valve 200 can be freely set the magnitude of the discharged compressed air.

First, when the hot air blower 10 in which the high-pressure regulation valve 40 and the low-pressure regulation valve 200 set to different pressures are installed is operated, the air introduced through the air suction port 10*a* passes through the introduction hole 28*a* to be introduced into the vane pump 28 and then compressed, and the compressed air discharged from the vane pump 28 moves to the injection nozzle 22*a* of the burner assembly 22 along the air line 28*c* to suck the fuel stored in the fuel tank 20 to supply the fuel.

Here, if the valve opening/closing switch 100 is set to close the discharge port 110 of the low-pressure regulation valve 200, when the compressed air of 10 psi is discharged from the vane pump 40 to the compression chamber 37*b*, the high-pressure regulation valve 40 set to 7 psi is opened to uniformly supply the compressed air to the injection nozzle 22*a* at 7 psi.

Therefore, the compressed air discharged from the vane pump 28 is discharged through the high-pressure regulation valve 40 to be supplied to the injection nozzle at 7 psi.

The fuel in the fuel tank is supplied by the pressure of the compressed air to be combusted to obtain a large amount of heat.

Referring to FIG. 8, the valve opening/closing switch 100 is set to close the discharge port 110 of the low-pressure regulation valve 200.

Meanwhile, in the case that the temperature in the space is substantially increased so that decrease of the heating value is needed, when the valve opening/closing switch 100 is rotated to open the discharge port 110 of the low-pressure regulation valve 200, the low-pressure regulation valve 200 set to 5 psi is opened to reduce the pressure of the compressed air in the compression chamber 37*b* to 5 psi to supply the compressed air into the injection nozzle 22*a* of the burner assembly 22.

That is, when a user rotates the handle 151 of the rotation drive part 150 to reduce the heating value of the hot air blower, the guide projection 155 of the rotation drive part 150 is raised along the inclined surface 134 of the valve body 130 so that the rotation drive part 150 moves in a direction spaced apart from the valve body 130 as shown in FIG. 9.

At this time, the stopper 135 formed at the inclined surface 134 stops rotation of the guide projection 155 of the rotation drive part 150 such that the rotation drive part 150 rotates to an appropriate angle.

As described above, rotation of the rotation drive part 150 pushes the packing member 154 of the valve opening/closing switch 100 toward the rotation drive part 150 to open the hole 47 of the discharge port 110.

Therefore, the ball 211 and the spring 212 in the discharge port 110 of the low-pressure regulation valve 200 are pushed to open the discharge port 110 to discharge the compressed air, and the discharged compressed air is discharged to the exterior of the valve opening/closing switch 100 through the discharge groove 132 of the valve body 130.

In this embodiment, while the high-pressure regulation valve 40 is nearer to the air line 28*c* than the low-pressure regulation valve 200, there is no affection even when their positions are changed.

Second Embodiment

Figure 10:
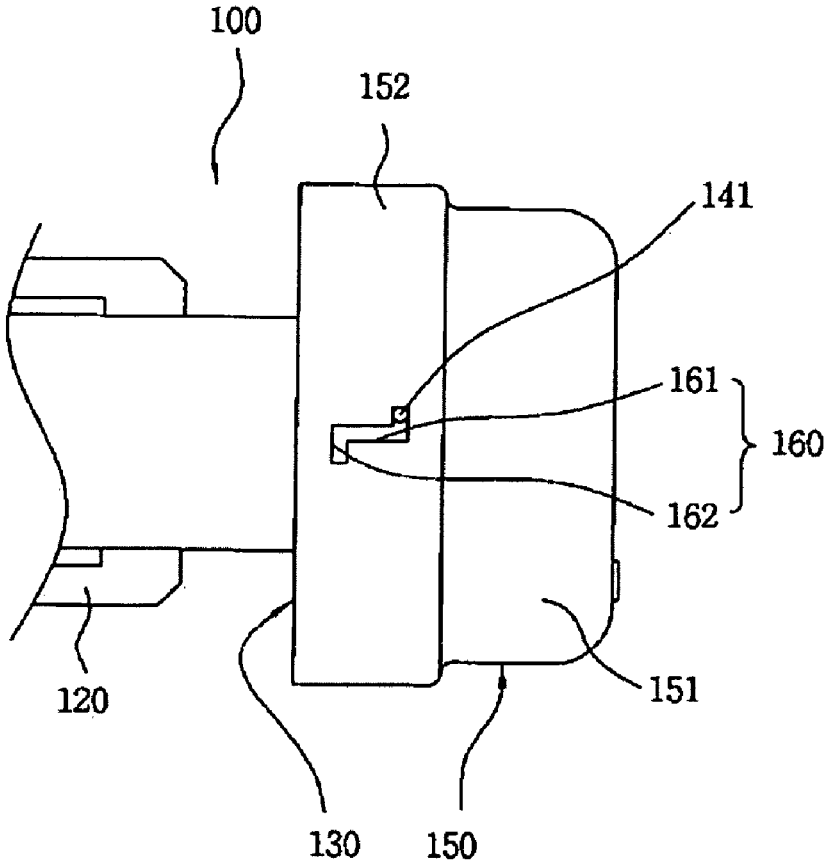
FIG. 10 is an exploded perspective view of a pressure regulation valve in accordance with a second exemplary embodiment of the present invention.

FIG. 10 is an exploded perspective view of a pressure regulation valve in accordance with a second exemplary embodiment of the present invention. Description of the same elements as the first embodiment will not be repeated.

In the second embodiment, a guide projection 141 is formed at a coupling part 133 of a valve body 130, not forming an inclined surface 134 at the valve body 130.

In addition, a guide hole 160 is formed in a coupling body 152 of a rotation drive part 150 such that the guide projection 141 is movably coupled thereinto. The guide hole 160 has a horizontal hole 161 formed in a longitudinal direction of the coupling body 152 and vertical holes 162 extending from both ends of the horizontal hole 161 in vertical opposite directions.

In the second embodiment, a user can rotate a handle 151 of the rotation drive part 150 to vary a coupling position between the guide projection 141 and the guide hole 160, and then move the handle forward or backward, and then rotate the handle 151 to lock the handle 151, thereby opening and closing the discharge port 110 of the pressure regulation valve 200 using the valve opening/closing switch 100.

Since other elements and operation of the other elements are the same as the first embodiment, description thereof will not be repeated.

Third Embodiment

Figure 11:
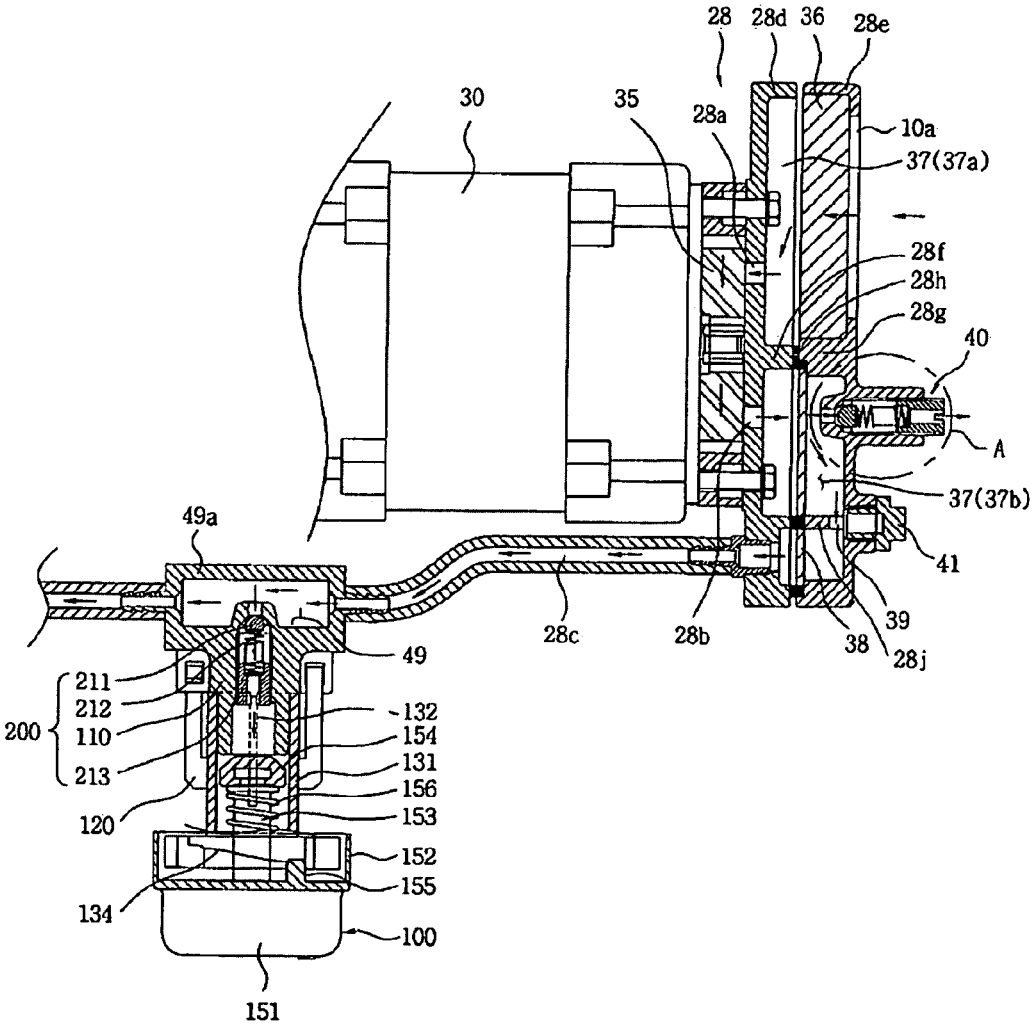
FIG. 11 is a partial cross-sectional view of a hot air blower in accordance with a third exemplary embodiment of the present invention.

FIG. 11 is a partial cross-sectional view of a hot air blower in accordance with a third exemplary embodiment of the present invention.

As shown in FIG. 11, the third embodiment is the same as the first embodiment, except that a low-pressure regulation valve 200 and a valve opening/closing switch 100 are installed at an air line 28*c* connecting the compression chamber 37*b* and the burner assembly 22.

In FIG. 11, a pressure reduction housing 49*a* is installed on the air line 28*c* to form a pressure reduction chamber 49, and the low-pressure regulation valve 200 is installed at the pressure reduction housing 49*a*.

Provided that the high-pressure regulation valve 40 is set to 7 psi and the low-pressure regulation valve 200 is set to 5 psi, when the compressed air of 10 psi is supplied into the compression chamber 37*b*, first, the high-pressure regulation valve 40 installed at the compression chamber 37*b* is opened to be reduced to 7 psi to enter the air line 28*c*.

Here, when the valve opening/closing switch 100 closes the low-pressure regulation valve 200, the compressed air of 7 psi moves to the burner assembly 22, and when the valve opening/closing valve 100 opens the low-pressure regulation valve 200, the low-pressure regulation valve 200 is opened to reduce the pressure of the compressed air to 5 psi to move the compressed air to the burner assembly 22.

In the first to third embodiments, while the valve opening/closing switch 100 is employed as a valve opening/closing means, a cap (not shown) may be employed as a valve opening/closing means by simply and manually pushing or pulling the cap, even though it is inconvenient.

As can be seen from the foregoing, the pressure of compressed air can be selectively regulated by a high-pressure regulation valve and a low-pressure regulation valve, which have different opening pressures, so that a heating value of a hot air blower can be readily adjusted to increase efficiency of the hot air blower.

Therefore, it is possible to readily adjust a heating value of the hot air blower and increase efficiency of the hot air blower.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

What is claimed is:

1. A hot air blower comprising:

a fuel tank for storing fuel;

an air compression pump for sucking air and compressing the air;

a pressure regulation valve installed at the air compression pump to reduce the pressure of the compressed air;

a burner assembly for receiving the fuel from the fuel tank and the air from the air compression pump; and a combustion chamber for receiving the fuel from the burner assembly and combusting the fuel, wherein the pressure regulation valve includes a high-pressure regulation valve and a low-pressure regulation valve, and a valve opening/closing means at the low pressure regulation valve;

wherein the valve opening/closing means includes a valve body coupled to the low-pressure regulation valve and a rotation drive part rotatably coupled to the valve body, the valve body including a coupling pipe coupled to the low-pressure regulation valve and having a compressed air discharge groove formed therearound, a coupling part formed at one end of the coupling pipe and having an inclined surface formed on a periphery of the coupling part and a coupling hole formed in its center, the rotation drive part including a coupling body rotatably coupled to the coupling part of the valve body, a guide projection extending in a direction parallel to a longitudinal axis of the coupling pipe from the coupling body and moving on the inclined surface of the valve body, a fixing rod extending in the same direction as the guide projection and inserted into the coupling hole, a packing member formed at an end of the fixing rod to open/close the low-pressure regulation valve, and a resilient member interposed between the packing member and the valve body.

2. The hot air blower according to claim 1, wherein the valve body has a stopper formed to stop rotation of the guide projection.

3. The hot air blower according to claim 1, wherein the valve body has stoppers formed at both ends of the inclined surface to stop rotation of the guide projection.

* * * * *